US005425415A

United States Patent [19]

Master et al.

[11] Patent Number: 5,425,415

[45] Date of Patent: Jun. 20, 1995

[54] VERTICAL HEAT EXCHANGER

[75] Inventors: Bashir I. Master, Wayne, N.J.; Adrianus C. J. Jansen, GE Aphen; Harry A. Wijnen Riems, Voorburg, both of Netherlands

[73] Assignee: ABB Lummus Crest Inc., Bloomfield, N.J.

[21] Appl. No.: 77,121

[22] Filed: Jun. 15, 1993

[51] Int. Cl.[6] ..... F28D 7/10

[52] U.S. Cl. ..... 165/154; 165/158; 165/159; 122/7 R; 122/348

[58] Field of Search ..... 165/158, 159, 155, 154, 165/164; 122/7 R, 16, 114, 155.1, 348

[56] References Cited

U.S. PATENT DOCUMENTS

| | | | |
|---|---|---|---|
| 1,351,500 | 8/1920 | Vincent | 122/348 X |
| 1,677,795 | 7/1928 | Oliver | 122/348 X |
| 2,429,916 | 10/1947 | Belgau | 122/348 X |
| 2,573,551 | 10/1951 | Denker et al. | 122/348 X |
| 3,566,961 | 3/1971 | Lorenz et al. | 165/159 |
| 3,871,445 | 3/1975 | Wanka et al. | 165/161 X |
| 4,236,576 | 12/1980 | Deuse et al. | 165/158 X |
| 4,336,770 | 6/1982 | Kaneko et al. | 122/7 R X |
| 4,589,473 | 6/1986 | Kehrer | 122/7 R X |
| 4,848,449 | 7/1989 | Brucher et al. | 165/160 |

FOREIGN PATENT DOCUMENTS

| | | | |
|---|---|---|---|
| 603110 | 4/1926 | France | 165/158 |
| 614877 | 9/1928 | Germany | 165/158 |
| 170697 | 9/1984 | Japan | 165/159 |
| 721373 | 1/1955 | United Kingdom | 122/7 R |
| 16659 | 6/1987 | United Kingdom | 165/158 |

OTHER PUBLICATIONS

Deutsch Babcock-Borsig Aktiengesellschaft; sales borchure entitled "Quench Cooler", 2 pages, date unknown.

Schmidt'sche Heissdamf GmbH; "Diagram For Double Tube Exchanger", 2 pages; dated Apr. 23, 1965.

*Primary Examiner*—John Rivell
*Assistant Examiner*—L. R. Leo
*Attorney, Agent, or Firm*—Chilton, Alix & Van Kirk

[57] ABSTRACT

A vertical heat exchanger including a vertical tube bundle connected between a lower inlet manifold and upper outlet manifold. The tube bundle comprises numerous pairs of concentric tubes with the inner tube being spaced from the outer tube to form an annular flow passage positioned around an inner flow passage. The inner tubes are welded between outer tube sheets that form a part of the upper and lower manifolds while the outer tubes are welded between inner tube sheets forming part of these manifolds. Each of the manifolds has a distributor ring which has radially directed openings throughout its periphery so as to provide for a radial flow in the manifold. Fluid enters the lower manifold through suitable inlet nozzles and exits the upper manifold through suitable outlet nozzles. A high temperature heating gas is directed up through the inner tubes of each pair of tubes by a conical inlet distributor and exits the upper end of the tube bundle through a similar conical distributor.

4 Claims, 2 Drawing Sheets

VERTICAL HEAT EXCHANGER

BACKGROUND OF THE INVENTION

This invention relates to vertically disposed heat exchangers employing a vertically oriented tube bundle interposed between upper and lower manifold arrangements organized to direct a heating medium, such as a high temperature gas, and a medium to be heated, such as water to be converted to steam, through the tube bundle and in indirect heat exchange relation with each other.

In conventional designs of such vertically oriented heat exchangers utilizing high temperature gas streams, rather complicated designs have been employed in order to assure proper sweeping of the tube sheets, particularly the hot tube sheet. Special channel arrangements and separate manifolds have been employed for this purpose. This often results in expensive, special welding as well as special header geometries which can be complicated as well as costly.

SUMMARY OF THE INVENTION

It is an object of the present invention to provide an improved vertically oriented heat exchanger that is of relatively simple and economic construction and extremely satisfactory in operation. The invention utilizes a tube bundle that is made up of double tube elements, i.e., one tube within another, to provide an inner flow passage and an annular flow passage disposed thereabout. This tube bundle is connected between upper and lower manifolds each of which includes two vertically spaced thin tube sheets connected together at their perimeters by an annular member to thereby form a manifold enclosure. A distributor ring is spaced radially inward from the annular member and has radially directed openings throughout its periphery to effect a radial flow in the manifold. Fluid is conveyed to and from the tube bundle by nozzles that extend through the annular member. The double tube elements are welded to the thin tube sheets thereby reinforcing the same with the outer tubes of each element being welded to the inner tube sheet while the inner tubes are welded to the outer tube sheet. A heating medium is directed through the tube bundle by means of vertically oriented distribution channels, which could be in the form of cones or other shapes, connected with the outer tube sheets.

DESCRIPTION OF THE PREFERRED EMBODIMENT

Figure 1:
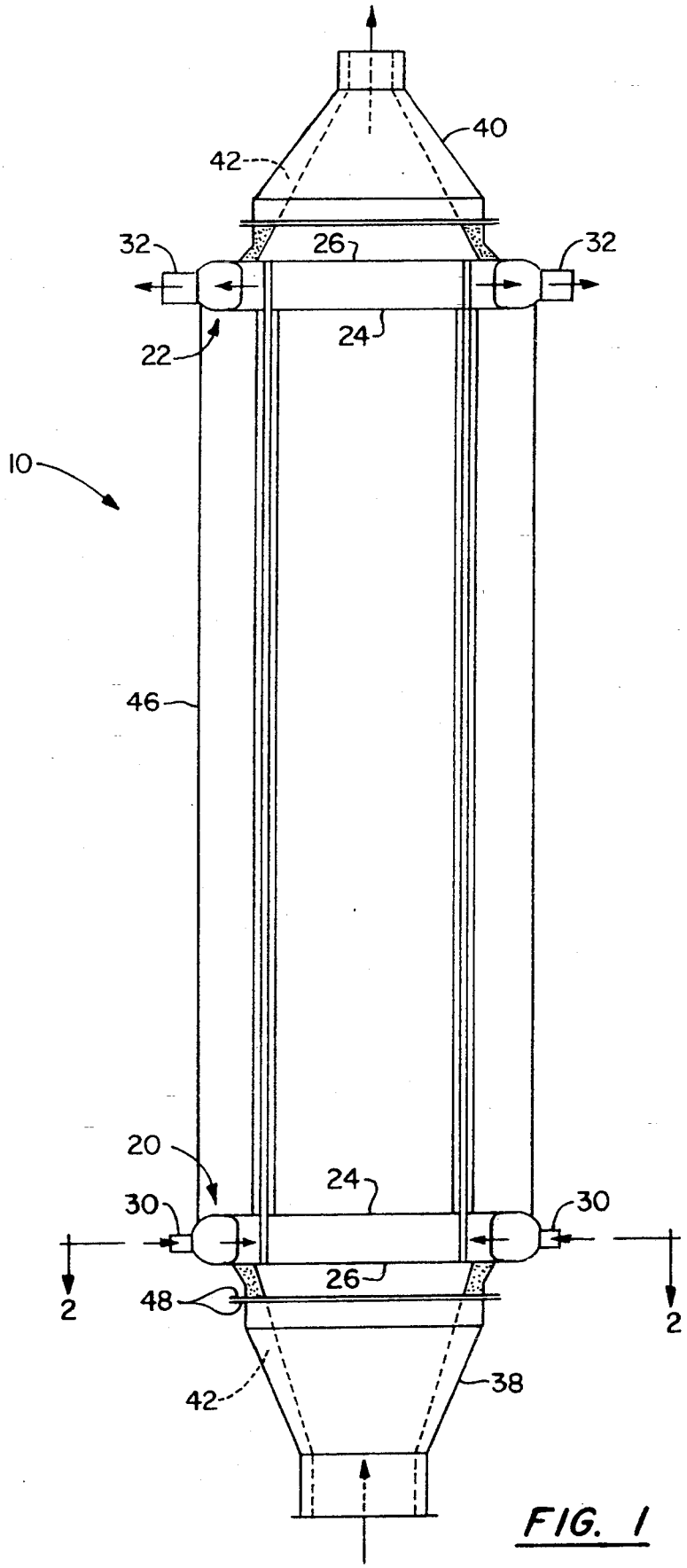
FIG. 1 is a view somewhat diagrammatic but in the nature of a vertical section through the vertical heat exchanger of the invention.
Figure 2:
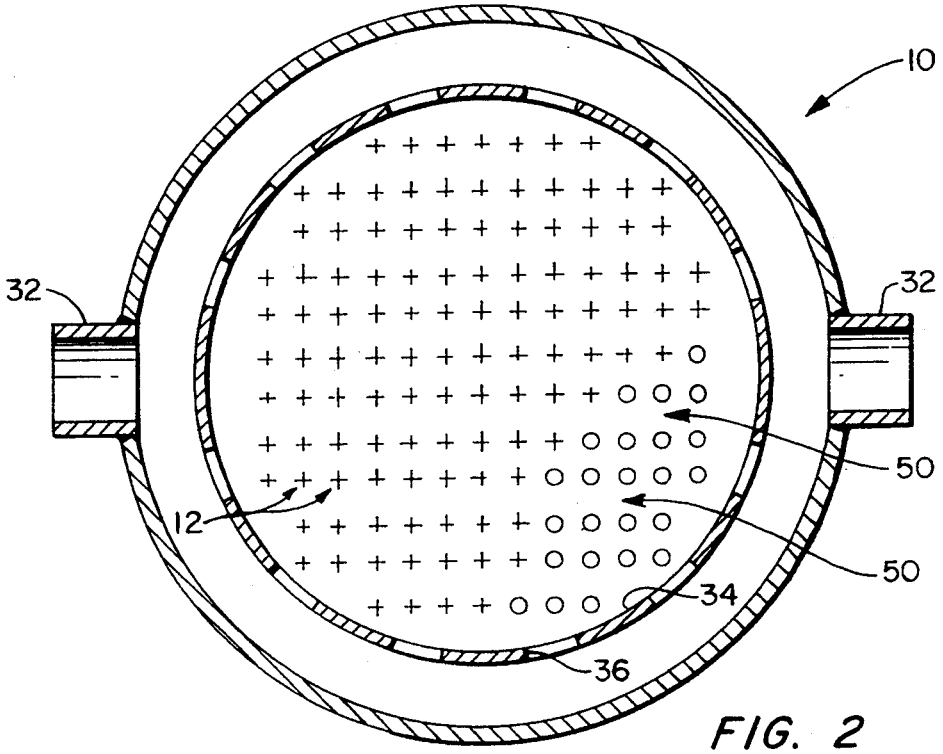
FIG. 2 is also somewhat diagrammatic and in the nature of a horizontal section taken along line 2—2 of FIG. 1.

Referring now to the drawings where like reference characters are used throughout to designate like elements, the invention will be described in relation to a preferred embodiment wherein the heat exchanger is employed as a vapor generator with a high temperature heating gas flowing up through the tube bundle and the fluid to be vaporized also flowing up through the tube bundle. It should be understood, however, that other heating mediums may be utilized with the invention.

The vertical heat exchanger includes a vertically oriented tube bundle 10 that is made up of laterally spaced tube elements 12 each of which includes an inner tube 14 and an outer tube 16 with these tubes being of sufficiently different diameters so as to form an ample annular flow passage 18 therebetween. The tube elements 12 of the vapor generator are connected between the lower manifold 20 and the upper manifold 22 in a manner such that high temperature heating gas is conveyed up through the interior of tubes 14 while the fluid to be vaporized, such as water, is conveyed up through the annulus 18. The manifolds 20 and 22 are identical and each includes an inner or cold tube sheet 24 and an outer or hot tube sheet 26. These tube sheets are circular and integrated into a manifold by the annular member 28 which is preferably semicircular in transverse section. Fluid to be vaporized is admitted into the lower manifold 20 by means of the nozzles 30 which penetrate the annular member 28 and are welded to this member with there being two such nozzles shown on diametrically opposite sides of the manifold. Similarly, a fluid and vapor mixture is conveyed from the manifold 22 by means of nozzles 32 connected with the annular member 28 of this upper manifold.

The inner tubes 14 of the tube bundle 10 are connected by welding to the outer tube sheet 26 while the outer tubes 16 are similarly connected to the inner tube sheet 24. These tubes thus reinforce these tube sheets which permits the tube sheets to be of relatively thin construction thereby lessoning thermal stress problems during operation as well as decreasing construction difficulties.

Figure 3:
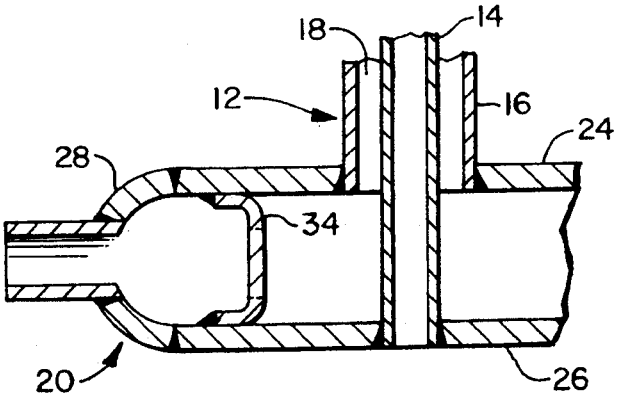
FIG. 3 is a detailed view of a portion of the lower manifold that forms part of the invention.
Figure 4:
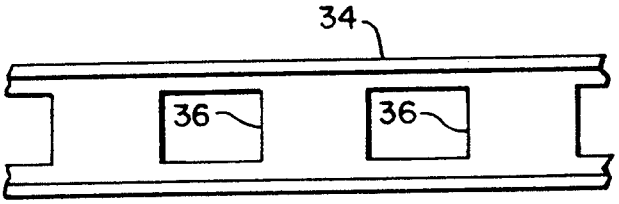
FIG. 4 is a fragmentary view showing the configuration of the openings in the distribution ring.

A radial flow is established within the manifolds 20 and 22 by means of an internal distributor ring 34 within each of these manifolds. This ring is positioned inwardly of the annular member 28 but outwardly of the outermost of the tube elements 12. As best seen in FIG. 3, the ring 34 is generally U-shaped in transverse section with the legs of the U being parallel with and welded at their extremities to their respective tube sheets 24 and 26. This permits relative movement between the tube sheets as may occur due to thermal expansion and contraction. The ring 34 is provided throughout its periphery with radially directed openings 36 as seen in FIG. 4. Thus, fluid entering the manifold 20 through the nozzles 30 will be substantially uniformly distributed throughout the manifold and radially directed across the ends of the tube bundles 10. Similarly, fluid will be radially directed out of the upper manifold 22 to the nozzles 32.

The high temperature heating gas is conveyed to and from the tube bundle 10 by means of the inlet and outlet conical distributors 38 and 40. These distributors are welded to the outer tube sheets 26 and each is made up of two parts with the two parts having complimentary mating flanges 48 that are secured together by bolt means (not shown) such that the outer most part of the conical distributor can be removed from the inner most part which is welded to the tube sheet 26. This inner most part is of limited vertical dimension so that once the outer most part is removed access can be had to the tube sheet 26 to effect any necessary repair including the removal of the inner tubes 14. The conical distributors 38 and 40 are internally insulated by means of cast refractory 42.

In order to provide access to the outer tubes 16 for repair and/or replacement, the tube bundle 10 is disposed in an array such that the alternate rows are additionally spaced to provide service lanes 50 through the tube layout permitting access to each of these outer tubes.

In order to protect personnel from exposure to the tube bundle 10, there is preferably provided an annular wire cage 46 that is connected to and extends between the upper and lower manifolds.

In operation, a single phase liquid, for example water, is admitted to the lower manifold through the diametrically opposed nozzles 30 and flows in a radial direction through the slots 36 in the distributor ring. A hot gas stream enters the heat exchanger through the lower conical distributor 38, passes up through the inner tubes 14 and exits through the conical distributor 40.

The liquid that enters the inlet manifold rises through the annular space 18 in the tube elements 12 with a portion of the liquid being vaporized as it passes up through this annulus 18. This liquid and vapor mixture then enters the upper manifold 22 and passes radially through the distributor rings slots 36 and exits the manifold through the diametrically opposed outlet nozzles 32. This mixture is then conveyed, as is conventional, to a drum or other apparatus for separating the vapor from the liquid. In a natural circulation vapor generator arrangement, the flow distribution into the tube bundle in the lower manifold 20 is self-compensating to maintain a uniform velocity profile across the bundle cross-section. This occurs primarily due to the radial entry into the tube bundle through the openings in the distributor ring 34 and the annular up flow of the two phase fluid in each of the tube elements 12. Flow velocity reduces as the flow enters radially into the tube bundle across the center of the bundle. As a consequence, a higher vapor fraction is generated in the annular flow passages 18 near the center of the tube bundle. This results in a low pressure area near the center of the tube bundle drawing more flow into this region and compensating to correct the velocity field to achieve a more even flow distribution over the face of the tube sheet. This self-compensating feature of the design along with the annular flow distribution arrangement prevents the accumulation of settled solids in the area where the tubes are joined to the tube sheet. The more even flow distribution also assures uniform cooling of the hot tube sheet and minimizes stresses due to thermal gradient through the tube sheets.

With the arrangement of the invention wherein the tube sheets are effectively reinforced by the tubes of bundle 10, the tube sheets are relatively thin while still having the necessary strength to withstand the pressures and temperatures encountered during operation of the heat exchanger. Because the tube sheets are thin they can readily accommodate the necessary expansion and contraction to which they are subjected and the stress problems that are encountered are considerably lessened. The invention eliminates the need for a containment shell as in conventional shell and tube heat exchangers. Further, the radial flow pattern at the inlet and outlet prevents the accumulation of deposit and fouling on the tubesheets and thereby reduces the potential for stress concentrations and corrosion.

An important result achieved by the present invention is that the velocity profile of the coolant in the various annular passes tends to be self regulated and equalized by the velocity profile of the heating gases in the tubes. Due to the flow pattern of the gases entering the heat exchanger through the inlet conical distributor, the tubes in the center core part of the exchanger will have a higher gas velocity and heat flux than the tubes in the outer part of the bundle. Conversely, the liquid which is entering radially will have a higher velocity in the annular channels on the outer part of the bundle than in the annular channels near the core region. The higher heat flux of the heating gas in the core region acts to draw more coolant to this core region because there is more vapor generated in that region. This effect tends to even out the coolant flow.

We claim:

1. A vertically oriented heat exchanger having no shell comprising:

a plurality of vertically disposed, laterally spaced tube elements each of which has an upper and a lower end, each of which includes an inner tube and a concentric outer tube spaced from each other to form an annular flow passage therebetween wherein said spaced tube elements are directly accessible from outside said heat exchanger;

manifold forming means at both the upper and lower ends of said spaced tube elements for directing a fluid to be heated through said annular flow passage and for collecting the fluid from said annular flow passage, each of said manifold forming means including a hot tube sheet to which said inner tube of the concentric tubes is welded at each end thereof and an adjacent cold tube sheet to which said outer tube of the concentric tubes is welded at each end thereof, each of said cold tube sheets being parallel to and closely spaced inwardly of said hot tube sheets; said spaced hot and cold tube sheets being of circular configuration and said adjacent hot and cold tube sheets being interconnected at their periphery by an annular member welded thereto to thereby provide a manifold communicating with said annular flow passage;

a distributor ring spaced inwardly of the annular member in each manifold, said distributor ring being of U-shaped transverse section welded to opposite tube sheets at the ends of the legs of said U-shape and provided throughout its peripheral extent with spaced, radially directed openings thereby forming an annular manifold surrounding each of said manifolds;

nozzle means communicating with each of these manifolds through said annular member to supply fluid to and convey fluid from the annular manifold and through said radially directed openings to and from said manifold; and flow means for directing a heating medium through the inner tube of the pair of concentric tubes and conveying the same from these tubes, said flow means including a conical member at each end of the heat exchanger axially parallel with the tube elements and welded to the hot tube sheet, each conical member including axially separate flanged portions removably secured together to permit access to the hot tube sheets.

2. The apparatus of claim 1 wherein the annular member is semicircular in tranverse section.

3. The apparatus of claim 1 wherein the concentric tube elements are arranged in rows with adjacent pairs of rows being spaced sufficiently to permit access for tube repair and removal.

4. The apparatus of claim 1 wherein there are a pair of diametrically opposed nozzles extending radially through the annular member at each end of the heat exchanger.

* * * * *